US006499736B2

(12) United States Patent
Hsieh

(10) Patent No.: US 6,499,736 B2
(45) Date of Patent: Dec. 31, 2002

(54) PAPER FEEDER FOR PAPERS WITH DIFFERENT THICKNESS

(75) Inventor: Yen-Sung Hsieh, Taipei (TW)

(73) Assignee: Benq Corporation, Taoyuan (TW)

( * ) Notice: Subject to any disclaimer, the term of this patent is extended or adjusted under 35 U.S.C. 154(b) by 75 days.

(21) Appl. No.: 09/800,577

(22) Filed: Mar. 8, 2001

(65) Prior Publication Data

US 2002/0066993 A1 Jun. 6, 2002

(30) Foreign Application Priority Data

Dec. 1, 2000 (TW) ..... 89125540

(51) Int. Cl.[7] ..... B65H 1/08
(52) U.S. Cl. ..... 271/147; 271/160
(58) Field of Search ..... 271/148, 160, 271/147

(56) References Cited

U.S. PATENT DOCUMENTS 4,049,257 A 9/1977 Bell et al.
4,429,863 A * 2/1984 Itoh et al. ..... 271/127
4,623,138 A * 11/1986 Sakamaki et al. ..... 271/160
4,765,605 A * 8/1988 Abbott ..... 271/127
4,852,869 A * 8/1989 Watanabe et al. ..... 271/126
5,029,838 A * 7/1991 Kunihiro ..... 271/117
6,039,315 A * 3/2000 Lim ..... 271/127

FOREIGN PATENT DOCUMENTS

EP 0330276 * 8/1989 ..... 271/160
JP 0191345 * 8/1987 ..... 271/160
JP 0028428 * 1/1990 ..... 271/160
JP 403249024 * 11/1991 ..... 271/160

OTHER PUBLICATIONS

Richard Carter Benson, Spring Ramp Paper Tray with Constant Lead Edge Height, Dec. 1980, Xerox, vol. 5 No. 6, p. 593.*

* cited by examiner

*Primary Examiner*—Christopher P. Ellis
*Assistant Examiner*—Richard Ridley
(74) *Attorney, Agent, or Firm*—Winston Hu

(57) ABSTRACT

A paper feeder includes a base plate, a movable paper holder for holding papers with a pivot fixed to the base plate and a rotating end positioned above the base plate in a rotatable way, a chute positioned on the bottom or the upper side of the movable holder, and an elastic device or a swing arm with one end positioned within the chute in a slidable way.

19 Claims, 9 Drawing Sheets

PAPER FEEDER FOR PAPERS WITH DIFFERENT THICKNESS

BACKGROUND OF THE INVENTION

1. Field of the Invention

The present invention relates to a paper feeder, and more particularly, to a paper feeder for papers with different thickness.

2. Description of the Prior Art

Please refer to FIG. 1 of a schematic diagram of a paper feeder 10 according to the prior art. The paper feeder 10 includes a plurality of pickup rollers 12, a replaceable friction pad 14, a pickup shaft 16, a movable paper holder 18, a base plate 22 positioned under the movable paper holder 18, and a spring 26 (shown in FIG. 2) positioned between the movable paper holder 18 and the base plate 22.

Please refer to FIG. 2 and FIG. 3 of the side views of the paper feeder 10 without and with the presence of paper, respectively. One end of the spring 26 is fixed to a bottom surface of the movable paper holder 18 while the other end is fixed to an upper surface of the base plate 22. Depending on whether paper is present in the paper feeder 10, the spring 26 is subjected to different stresses while the movable paper holder 18 is subjected to different reaction forces. For instance, a small amount of paper on the movable paper holder 18 creates a comparatively smaller amount of force on the movable paper holder 18 by the pickup rollers 12. Under such condition the force is not large enough to collect the paper properly so misfeeding may happen. A large amount of papers on the movable paper holder 18 creates a comparatively larger amount of force on the movable paper holder 18 by the pickup rollers 12. Under such condition the force is too large so multi-feeding may happen. Please refer to FIG. 4 of a schematic diagram of the required pressing forces of the paper feeder 10 for papers 202, 204, 206, 208, and 210 with different thickness. For example, paper 202 has the greatest thickness and a pressing force between 12 to 70 grams is suitable for collecting one sheet of paper, whereby a pressing force of less than 12 grams may lead to misfeeding, and a pressing force greater than 70 grams may lead to multi-feeding. According to the degree of stress on the spring 26, the pressing force provided by the pickup rollers 12 is between 10 to 30 grams. When the pressing force is between 10 to 12 grams, the pickup rollers 12 cannot collect the paper 202; when the pressing force is between 25 to 30 grams, the pickup rollers 12 may collect more than a single sheet of paper 210.

Due to the wide range in pressing force, the pickup rollers 12 can only correctly collect the papers 204, 206 and 208, whereby use of other types of paper can lead to multi-feeding or misfeeding. Thus, the paper feeder 10 is not very convenient for users who require the use of various types of paper.

SUMMARY OF THE INVENTION

It is an object of the present invention to provide a paper feeder with a smaller range in pressing force than the paper feeder of the prior art and it is suitable for handling paper with different thickness.

In accordance with one embodiment of the present invention, a paper feeder includes a base plate, a movable paper holder with a pivot fixed to the base plate and a rotating end positioned above the base plate in a rotatable way, a chute set on the bottom or the upper side of the movable holder, and an elastic device or a swing arm with one end positioned within the chute in a slidable way.

It is an advantage of the present invention that with or without paper, the pressing force provided by the pickup rollers is comparatively closer in range so that the paper feeder is suitable for handling paper of different thickness.

These and other objectives of the present invention will no doubt become obvious to those of the ordinary skill in the art after reading the following detailed description of the preferred embodiment which is illustrated in the various figures and drawings.

DETAILED DESCRIPTION OF THE PREFERRED EMBODIMENT

Figure 1:
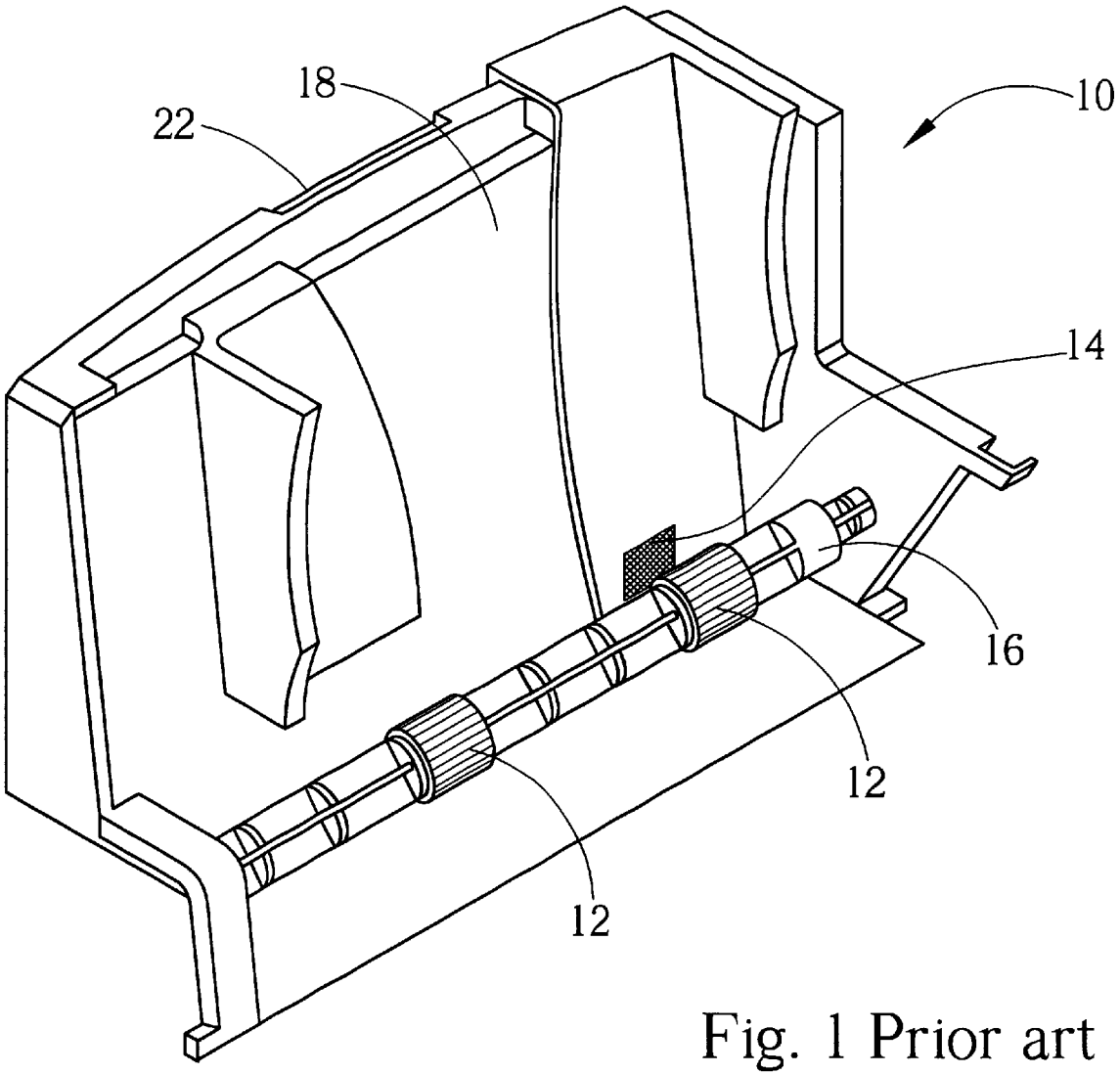
Fig. 1 Prior art
FIG. 1 is a schematic diagram of a paper feeder according to the prior art.
Figure 2:
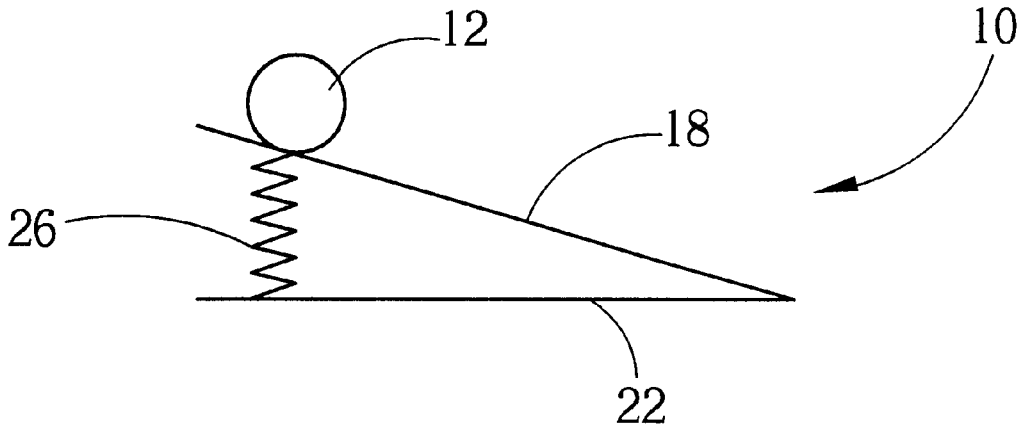
Fig. 2 Prior art
FIG. 2 is a side view of the paper feeder in FIG. 1 without papers.
Figure 3:
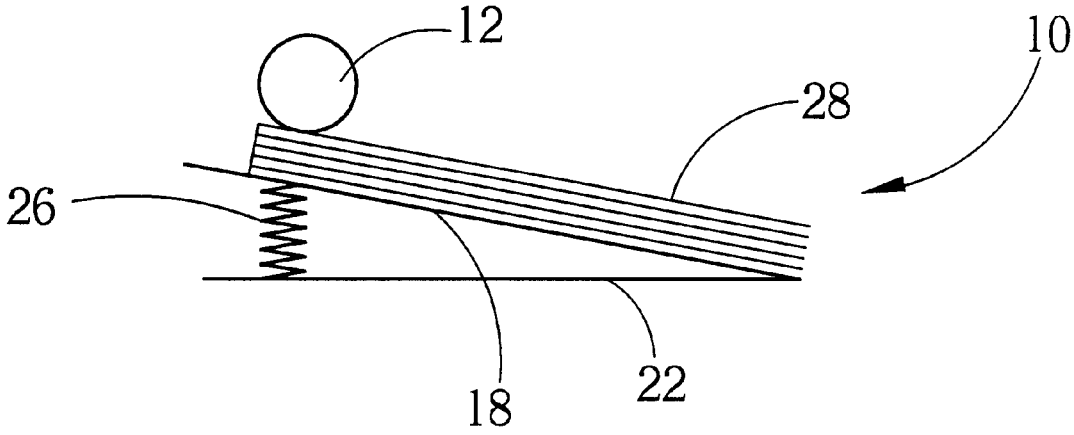
Fig. 3 Prior art
FIG. 3 is a side view of the paper feeder in FIG. 1 with the presence of papers.
Figure 4:
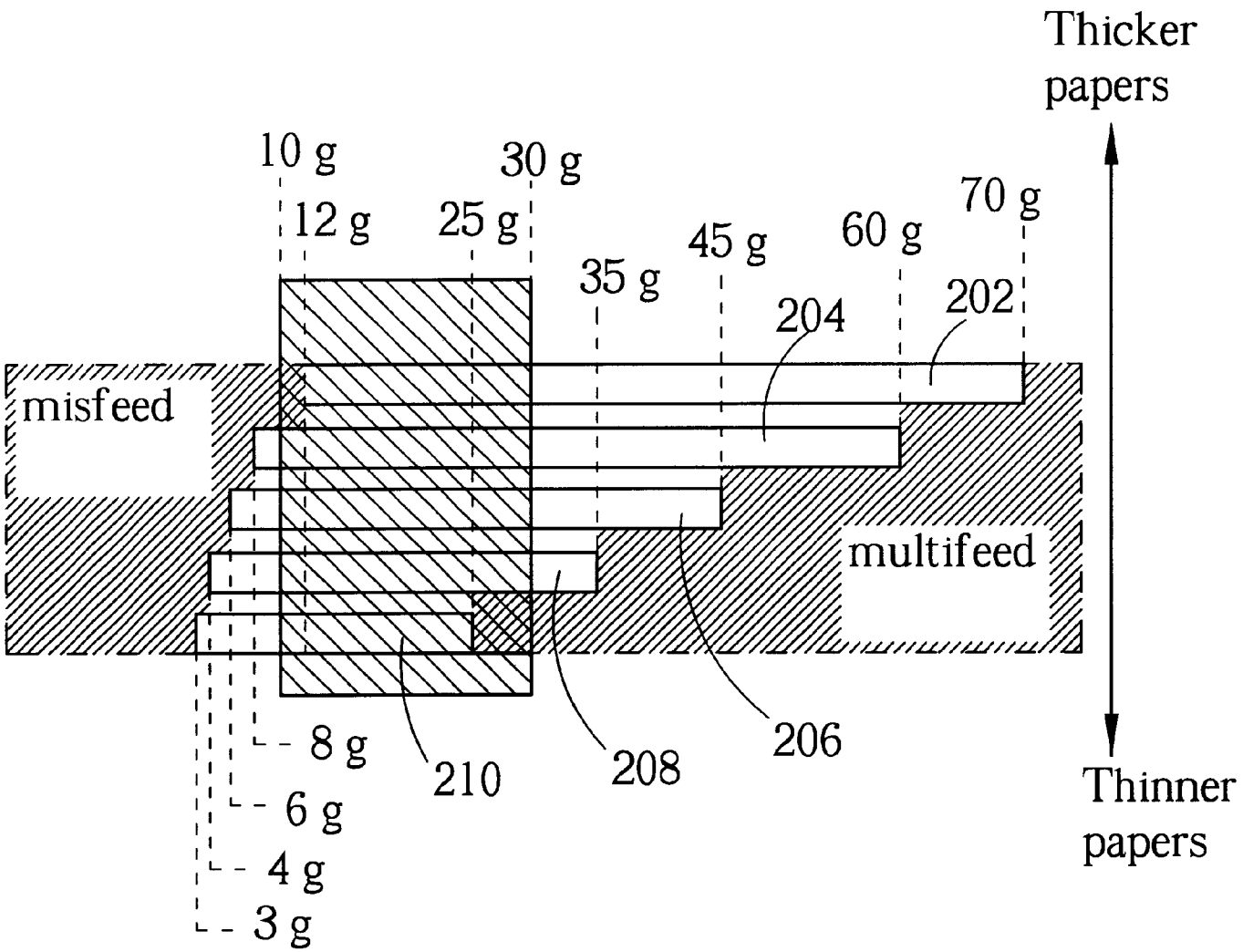
Fig. 4 Prior art
FIG. 4 is a schematic diagram of required pressing forces of the paper feeder in FIG. 1 for different kinds of papers.
Figure 5:
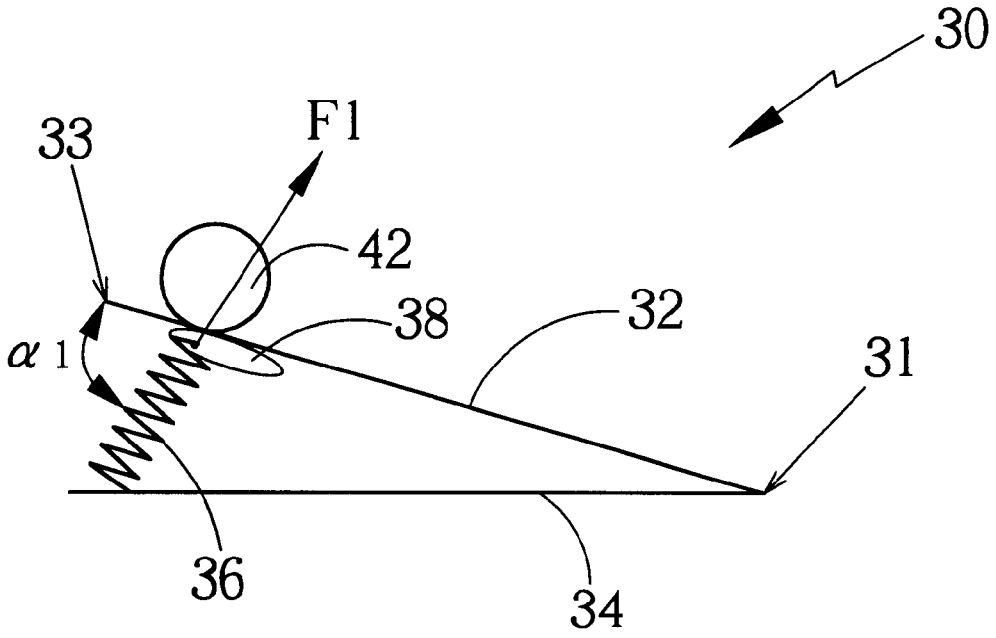
FIG. 5 is a side view of one embodiment according to the present invention without papers.
Figure 6:
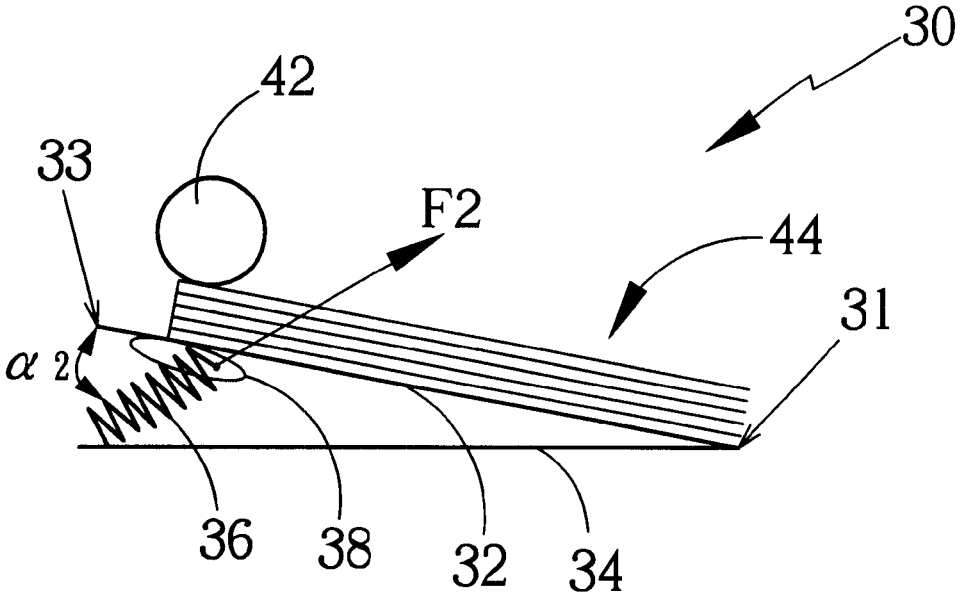
FIG. 6 is a side view of one embodiment of the present invention with the presence of papers.

Please refer to FIG. 5 and FIG. 6 of the side views of one embodiment according to the present invention paper feeder without paper and full of paper, respectively. The paper feeder 30 includes a movable paper holder 32, a base plate 34, a pickup roller 42, a spring 36 positioned between the movable paper holder 32 and the base plate 34, and a chute 38 positioned on the bottom side of the movable paper holder 32. An upper end of the spring 36 is set within the chute 38 in a slidable way, and a lower end of the spring 36 is fixed to the base plate 34. The movable paper holder 32 includes a pivot 31 fixed to the base plate 34 and a rotating end 33 positioned above the base plate 34 in a rotatable way. The pickup roller 42 is positioned above the movable paper holder 32.

Assuming that the force generated by the spring 36 to the movable paper holder 32 without paper is F1 and meanwhile the acute angle between the movable paper holder 32 and the spring 36 is $\alpha 1$, then the effective force generated by the spring 36 vertical to the movable paper holder 32 equals to $F1*\sin\alpha 1$. Thereafter, the effective force $F1*\sin\alpha 1$ vertical to the movable paper holder 32 is directly related to the force provided by the pickup roller 42 to pick up the paper.

Assuming that the force generated by the spring 36 to the movable paper holder 32 full of paper changes to F2 and the acute angle between the movable paper holder 32 and the spring 36 changes to $\alpha 2$, the effective force of the spring 36 vertical to the movable paper holder 32 changes to $F2*\sin\alpha 2$. Thereafter, the effective force $F2*\sin\alpha 2$ vertical to the movable paper holder 32 is directly related to the force provided by the pickup roller 42 to pick up the paper. Increasing the amount of paper on the movable paper holder 32 is to lead an increase the force provided by the spring 36 and a decrease of the acute angle between the movable paper holder 32 and the spring 36 spontaneously. By choosing the movable paper holder 32 and the spring 36 and adjusting the both positions of the chute 38 on the bottom side of the movable paper holder 32 and the spring 36 fixed to the base plate 34 appropriately, the value of $F1*\sin\alpha 1$ can be chosen as close as that of $F2*\sin\alpha 2$. As this result, the effective forces provided by the spring 36 vertical to the movable paper holder 32 are similar no matter how many papers on the paper feeder 30. Furthermore, the pressing force provided by the pickup roller 42 for collecting paper remains comparatively similar, and the paper feeder 30 is suitable for many kinds of paper with different thickness.

Figure 7:
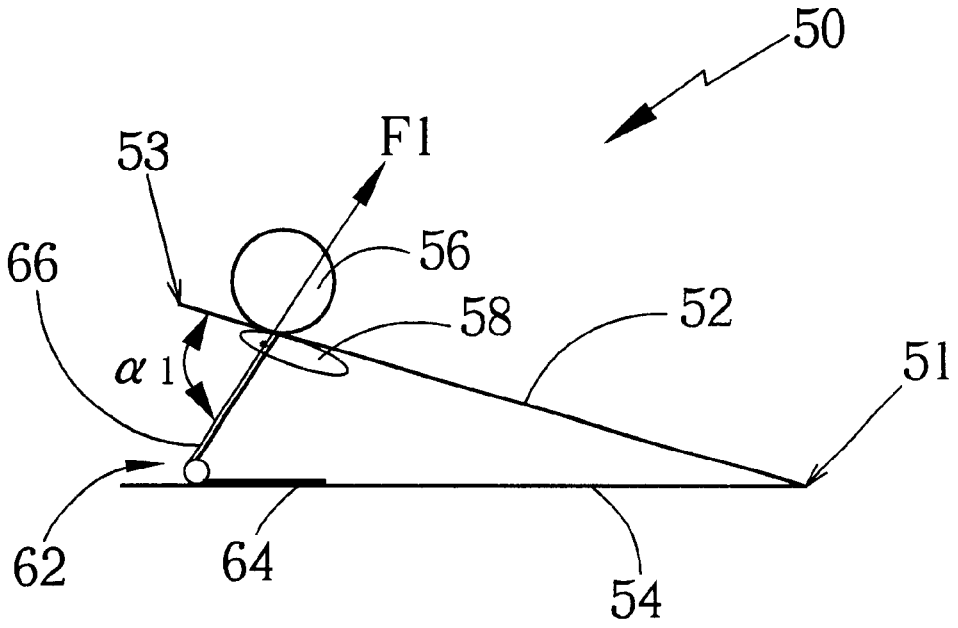
FIG. 7 is a side view of another embodiment of the present invention without papers.
Figure 8:
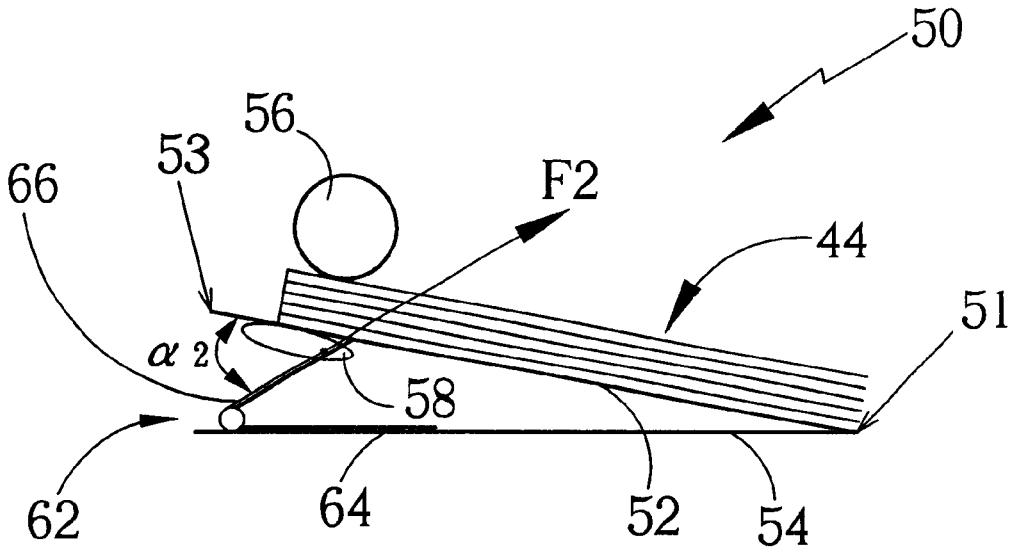
FIG. 8 is a side view of the embodiment shown in FIG. 7 with the presence of papers.

Please refer to FIG. 7 and FIG. 8 of the side views of the second embodiment paper feeder 50 without paper and full of paper, respectively, according to the present invention. The paper feeder 50 includes a movable paper holder 52, a base plate 54, a pickup roller 56, a chute 58 positioned on the bottom side of the movable paper holder 52, a torsion spring 62 with a fixed arm 64 positioned on the upper surface of the base plate 54, and a swing arm 66. One end of the swing arm 66 is positioned within the chute 58 in a slidable way. The movable paper holder 52 includes a pivot 51 fixed to the base plate 54 and a rotating end 53 set above the base plate 54 in a rotatable way. The pickup roller 56 is positioned above the movable paper holder 52.

Assuming that the force generated by the torsion spring 62 to the movable paper holder 52 without paper is F1 and meanwhile the acute angle between the movable paper holder 52 and the torsion spring 62 is $\alpha 1$, then the effective force generated by the torsion spring 62 vertical to the movable paper holder 52 equals to $F1*\sin\alpha 1$. Thereafter, the effective force $F1*\sin\alpha 1$ vertical to the movable paper holder 52 is directly related to the force provided by the pickup roller 56 to pick up the paper.

Assuming that the force generated by the torsion spring 62 to the movable paper holder 52 full of paper changes to F2 and the acute angle between the movable paper holder 52 and the torsion spring 62 changes to $\alpha 2$, the effective force of the torsion spring 62 vertical to the movable paper holder 52 changes to $F2*\sin\alpha 2$. Thereafter, the effective force $F2*\sin\alpha 2$ vertical to the movable paper holder 52 is directly related to the force provided by the pickup roller 56 to pick up the paper. Increasing the amount of paper on the movable paper holder 52 is to lead an increase the force provided by the torsion spring 62 and a decrease of the acute angle between the movable paper holder 52 and the torsion spring 62 spontaneously. By choosing the movable paper holder 52 and the torsion spring 62 and adjusting the both positions of the chute 58 on the bottom side of the movable paper holder 52 and the torsion spring 62 fixed to the base plate 54 appropriately, the value of $F1*\sin\alpha 1$ can be chosen as close as that of $F2*\sin\alpha 2$. As this result, the effective forces provided by the torsion spring 62 vertical to the movable paper holder 52 are similar no matter how many papers on the paper feeder 50. Furthermore, the pressing force provided by the pickup roller 56 for collecting paper remains comparatively similar, and the paper feeder 50 is suitable for many kinds of paper with different thickness.

Figure 9:
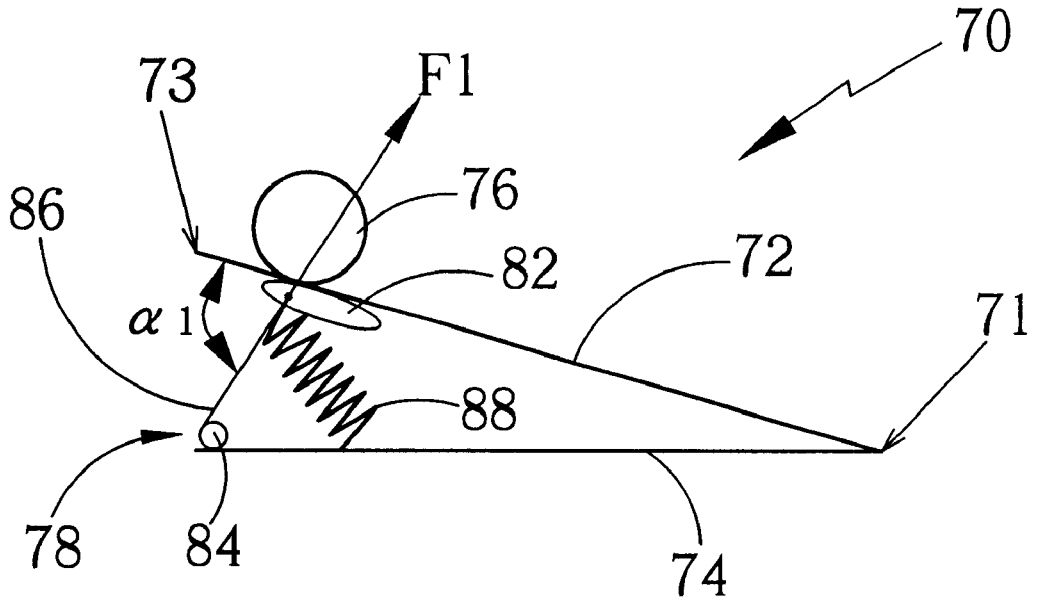
FIG. 9 is a side view of another embodiment of the present invention without papers.
Figure 10:
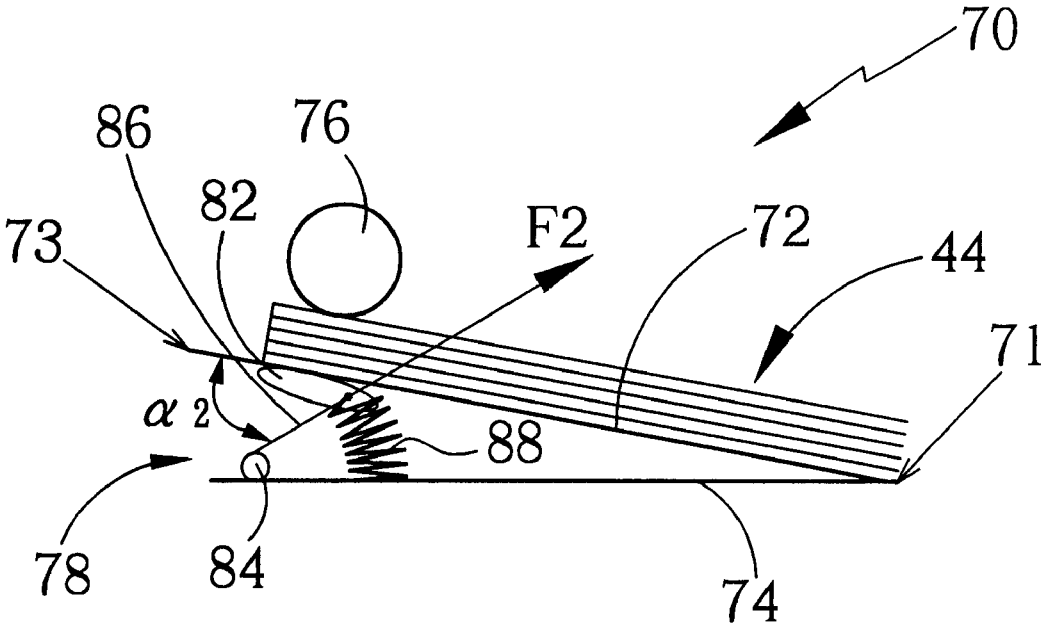
FIG. 10 is a side view of the embodiment in FIG. 9 with the presence of papers.

Please refer to FIG. 9 and FIG. 10 of the side views of the third embodiment paper feeder 70 without paper and full of paper, respectively, according to the present invention. The paper feeder 70 includes a movable paper holder 72, a base plate 74, a pickup roller 76, a connecting rod 78 positioned between the movable paper holder 72 and the base plate 74, and a chute 82 positioned on the bottom side of the movable paper holder 72. The connecting rod 78 includes a pivot 84 fixed to the base plate 74 and a rotating arm 86. One end of the rotating arm 86 is positioned within the chute 82 in a slidable way. The paper feeder 70 further includes a spring 88 positioned between the base plate 74 and the rotating arm 86. The movable paper holder 72 includes a pivot 71 fixed to the base plate 74 and a rotating end 73 set above the base plate 74 in a rotatable way. The pickup roller 76 is positioned above the movable paper holder 72.

Assuming that the force generated by the spring 88 to the movable paper holder 72 without paper is F1 and meanwhile the acute angle between the movable paper holder 72 and the rotating arm 86 of the connecting rod 78 is $\alpha 1$, then the effective force generated by the spring 88 vertical to the movable paper holder 72 equals to $F1*\sin\alpha 1$. Thereafter, the effective force $F1*\sin\alpha 1$ vertical to the movable paper holder 72 is directly related to the force provided by the pickup roller 76 to pick up the paper.

Assuming that the force generated by the spring 88 to the movable paper holder 72 full of paper changes to F2 and the acute angle between the movable paper holder 72 and the rotating arm 86 of the connecting rod 78 changes to $\alpha 2$, the effective force of the spring 88 vertical to the movable paper holder 72 changes to $F2*\sin\alpha 2$. Thereafter, the effective force $F2*\sin\alpha 2$ vertical to the movable paper holder 72 is directly related to the force provided by the pickup roller 76 to pick up the paper. Increasing the amount of paper on the movable paper holder 72 is to lead an increase the force provided by the spring 88 and a decrease of the acute angle between the movable paper holder 72 and the rotating arm 86 of the connecting rod 78 spontaneously. By choosing the movable paper holder 72 and the spring 88 and adjusting both positions of the chute 82 on the bottom side of the movable paper holder 72 and the spring 88 fixed to the base plate 74, the value of $F1*\sin\alpha 1$ can be chosen as close as that of $F2*\sin\alpha 2$. As this result, the effective forces provided by the spring 88 vertical to the movable paper holder 72 are similar no matter how many papers on the paper feeder 70. Furthermore, the pressing force provided by the pickup roller 76 for collecting paper remains comparatively similar, and the paper feeder 70 is suitable for many kinds of paper with different thickness.

Figure 11:
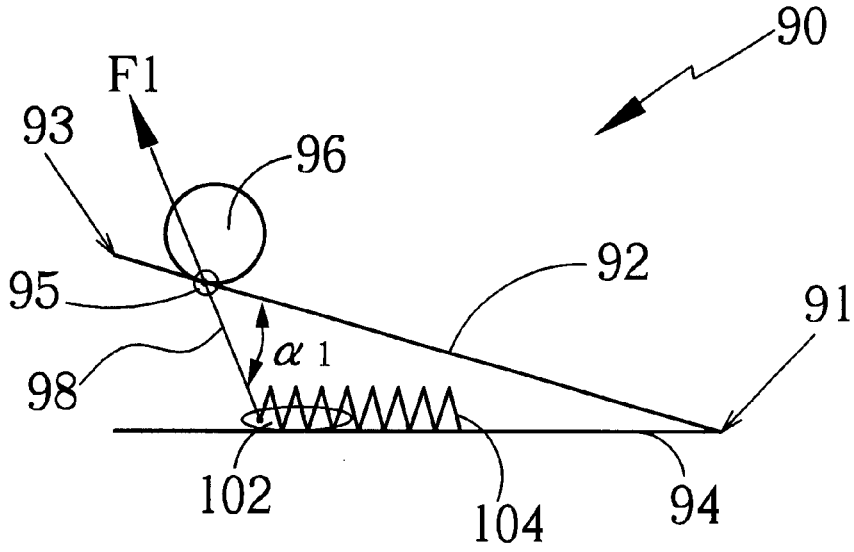
FIG. 11 is a side view of another embodiment of the present invention without papers.
Figure 12:
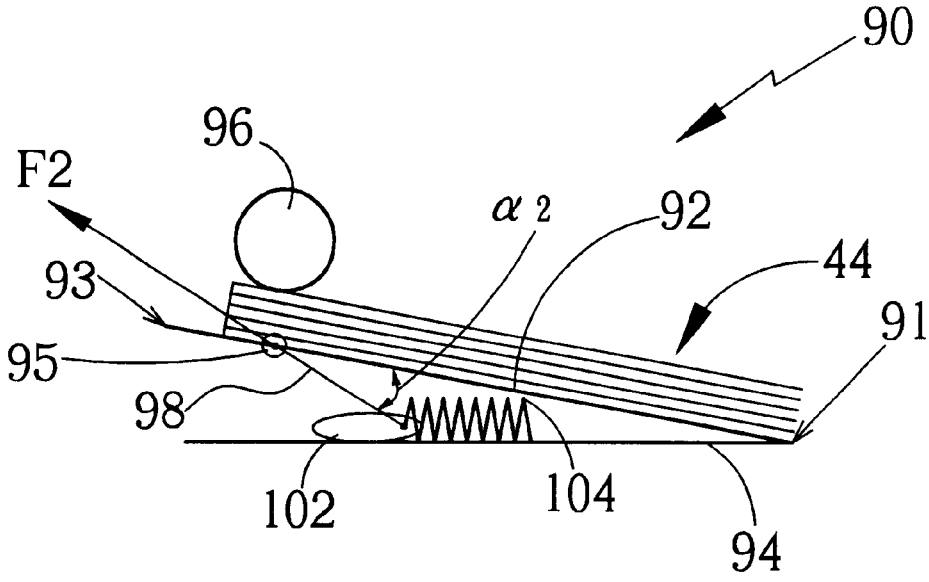
FIG. 12 is a side view of the embodiment in FIG. 11 with the presence of papers.

Please refer to FIG. 11 and FIG. 12 of the side views of the fourth embodiment paper feeder 90 without paper and full of paper, respectively, according to the present invention. The paper feeder 90 includes a movable paper holder 92, a base plate 94, a pickup roller 96, a connecting rod 98 positioned between the movable paper holder 92 and the base plate 94, a chute 102 positioned on the upper side of the base plate 94, and a spring 104 positioned on the upper side of the base plate 94. One end of the spring 104 is fixed to a predetermined position of the base plate 94, while the other end of the spring 104 and the lower end of the connecting rod 98 are positioned within the chute 102 in a slidable way. The upper end of the connecting rod 98 is fixed to a predetermined position of the bottom side of the movable paper holder 92 through a pivot 95. The movable paper holder 92 includes a pivot 91 fixed to the base plate 94 and a rotating end 93 set above the base plate 94 in a rotatable way. The pickup roller 96 is positioned above the movable paper holder 92.

Assuming that the force generated by the spring 104 to the movable paper holder 92 without paper is F1 and meanwhile the acute angle between the movable paper holder 92 and the connecting rod 98 is $\alpha 1$, then the effective force generated by the spring 104 vertical to the movable paper holder 92 equals to $F1*\sin\alpha 1$. Thereafter, the effective force $F1*\sin\alpha 1$ vertical to the movable paper holder 92 is directly related to the force provided by the pickup roller 96 to pick up the paper.

Assuming that the force generated by the spring 104 to the movable paper holder 92 full of paper changes to F2 and the acute angle between the movable paper holder 92 and the connecting rod 98 changes to $\alpha 2$, the effective force of the spring 104 vertical to the movable paper holder 92 changes to $F2*\sin\alpha 2$. Thereafter, the effective force $F2*\sin\alpha 2$ vertical to the movable paper holder 92 is directly related to the force provided by the pickup roller 96 to pick up the paper. Increasing the amount of paper on the movable paper holder 92 is to lead an increase the force provided by the spring 104 and a decrease of the acute angle between the movable paper holder 92 and the connecting rod 98 spontaneously. By choosing the movable paper holder 92 and the spring 104 and adjusting both positions of the chute 102 on the upper side of the base plate 94 and the spring 104 fixed to the base plate 94, the value of $F1*\sin\alpha 1$ can be chosen as close as that of $F2*\sin\alpha 2$. As this result, the effective forces provided by the spring 104 vertical to the movable paper holder 92 are similar no matter how many papers on the paper feeder 90. Furthermore, the pressing force provided by the pickup roller 96 for collecting paper remains comparatively similar, and the paper feeder 90 is suitable for many kinds of paper with different thickness.

Figure 13:
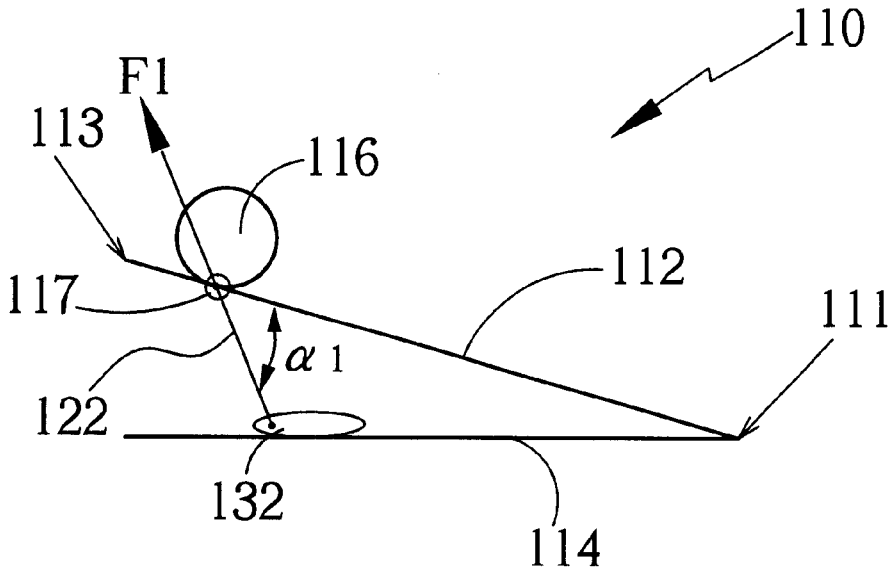
FIG. 13 is a side view of another embodiment of the present invention without papers.
Figure 14:
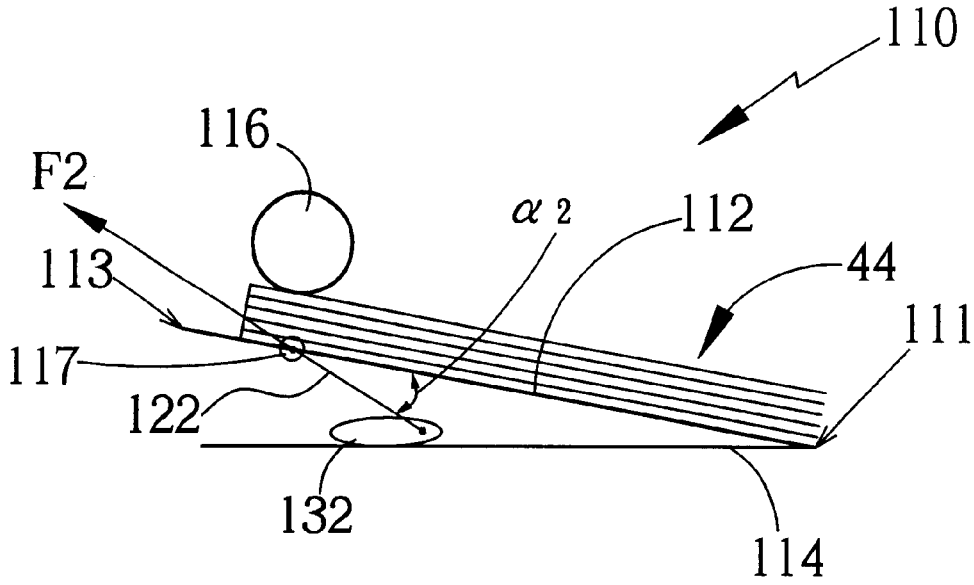
FIG. 14 is a side view of the embodiment in FIG. 13 with the presence of papers.

Please refer to FIG. 13 and FIG. 14 of the side views of the fifth embodiment paper feeder 110 without paper and full of paper, respectively, according to the present invention. The paper feeder 110 includes a movable paper holder 112, a base plate 114, a pickup roller 116, a torsion spring 122 positioned between the movable paper holder 112 and the base plate 114, and a chute 132 positioned on the upper side of the base plate 114. The torsion spring 122 is positioned within the chute 132 in a slidable way with its upper end fixed to the bottom side of the movable paper holder 112 through a pivot 117. The movable paper holder 112 includes a pivot 111 fixed to the base plate 114 and a rotating end 113 set above the base plate 114 in a rotatable way. The pickup roller 116 is positioned above the movable paper holder 112.

Assuming that the force generated by the torsion spring 122 to the movable paper holder 112 without paper is F1 and meanwhile the acute angle between the movable paper holder 112 and the torsion spring 122 is $\alpha 1$, then the effective force generated by the torsion spring 122 vertical to the movable paper holder 112 equals to $F1*\sin\alpha 1$. Thereafter, the effective force $F1*\sin\alpha 1$ vertical to the movable paper holder 112 is directly related to the force provided by the pickup roller 116 to pick up the paper.

Assuming that the force generated by the torsion spring 122 to the movable paper holder 112 full of paper changes to F2 and the acute angle between the movable paper holder 112 and the torsion spring 122 changes to $\alpha 2$, the effective force of the torsion spring 122 vertical to the movable paper holder 112 changes to $F2*\sin\alpha 2$. Thereafter, the effective force $F2*\sin\alpha 2$ vertical to the movable paper holder 112 is directly related to the force provided by the pickup roller 116 to pick up the paper. Increasing the amount of paper on the movable paper holder 112 is to lead an increase the force provided by the torsion spring 122 and a decrease of the acute angle between the movable paper holder 112 and the torsion spring 122 spontaneously. By choosing the movable paper holder 112 and the torsion spring 122 and adjusting both positions of the chute 132 on the upper side of the base plate 114 and the pivot 117 on the bottom surface of the movable paper holder 122, the value of $F1*\sin\alpha 1$ can be chosen as close as that of $F2*\sin\alpha 2$. As this result, the effective forces provided by the torsion spring 122 vertical to the movable paper holder 112 are similar no matter how many papers on the paper feeder 110. Furthermore, the pressing force provided by the pickup roller 116 for collecting paper remains comparatively similar, and the paper feeder 110 is suitable for many kinds of paper with different thickness.

Figure 15:
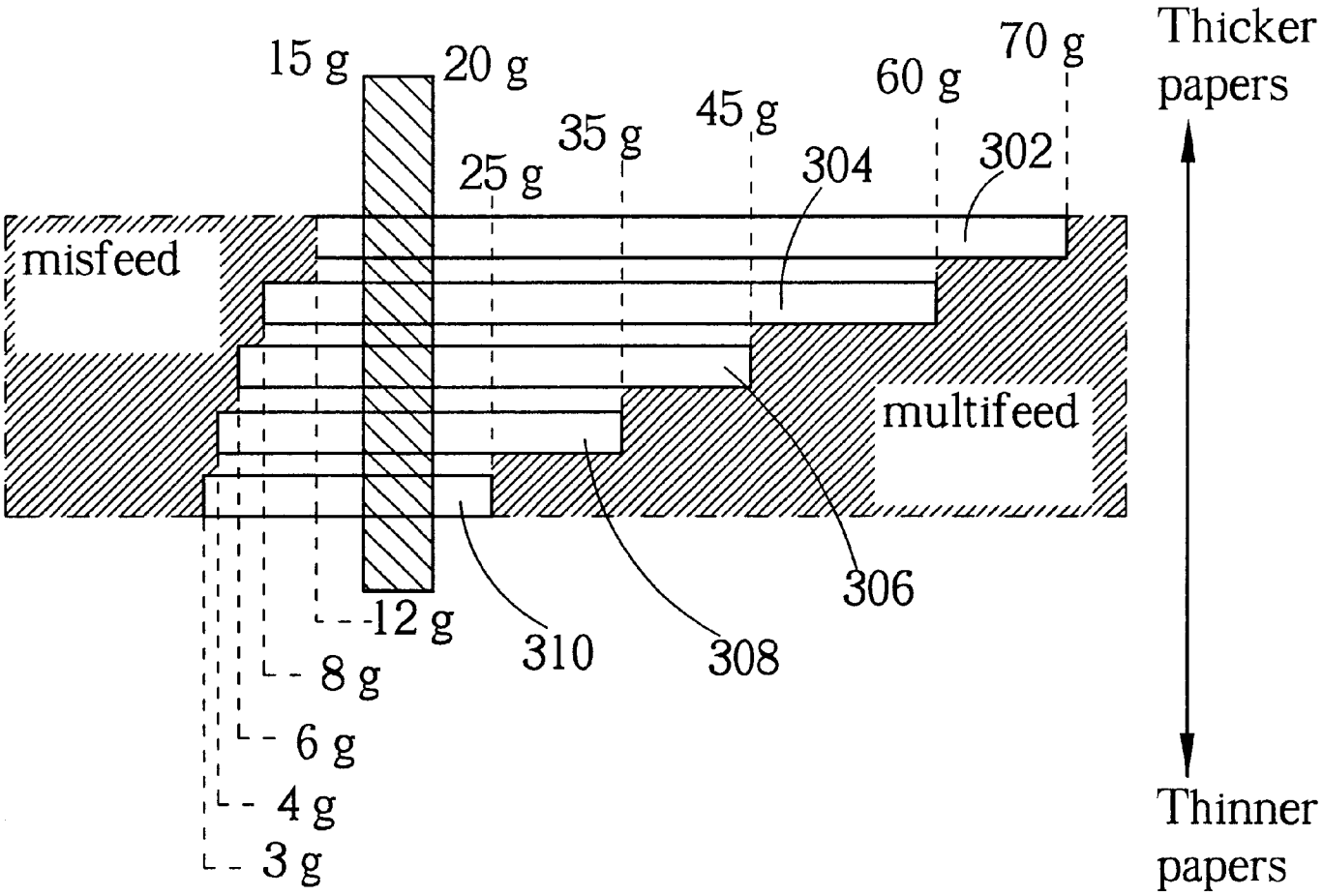
FIG. 15 is a schematic diagram of the paper feeder according to the present invention for papers with different thickness.

Please refer to FIG. 15 of a schematic diagram of he required forces for collecting papers 302, 304, 306, 308 and 310 with different thickness, of paper feeders 30, 50, 70, 90, and 110. For example, taking the thickest paper 302, a single sheet of paper can be correctly collected when the pressing force is between 12 to 70 grams. Another example, taking the thinnest paper 310, a single sheet of paper can also be correctly collected when the pressing force is between 3 to 25 grams. As shown in FIG. 15, pickup rollers 42, 56, 76, 96, and 116 exert a pressing force of 20 grams on the papers when paper feeders 30, 50, 70, 90, and 110 are full of paper while they exert a pressing force of 15 grams on the papers when the paper feeders 30, 50, 70, 90, and 110 are without paper. Therefore, the paper feeders 30, 50, 70, 90, and 110 can collect a single piece of paper 302, 304, 306, 308, and 310 with different thickness.

According to the above embodiments of the present invention, the angle between the springs or the torsion springs and the movable paper holders is adjusted to compensate for the changes in the force of the spring to decrease the range of the pressing force by the pickup rollers so that the paper feeders can correctly collect paper with different thickness. In this way, the possibilities of misfeeding or multifeeding are effectively reduced.

In comparison to the prior art paper feeder 10, the range of the pressing force for the pickup rollers 42, 56, 76, 96, 116 of the paper feeders 30, 50, 70, 90, and 110 is comparatively smaller so that paper with different thickness can be collected.

Those skilled in the art will readily observe that numerous modifications and alterations of the device may be made while retaining the teachings of the invention. Accordingly, the above disclosure should be construed as limited only by metes and bounds of the appended claims.

What is claimed is:

1. A paper feeder comprising:

a base plate;

a movable paper holder for holding papers, comprising a pivot fixed to the base plate and a rotating end positioned above the base plate in a rotatable way;

a chute set on the bottom side of the movable paper holder; and an elastic device, with one end pivoted to the base plate, and the other end set within the chute in a slidable way.

2. The paper feeder of claim 1 further comprises a pickup roller positioned above the movable paper holder for picking up papers.

3. The paper feeder of claim 1 wherein the elastic device forms an acute angle with the extending rotating end of the movable paper holder.

4. The paper feeder of claim 1 wherein the elastic device is a spring.

5. The paper feeder of claim 1 wherein the elastic device is a swing arm of a torsion spring, which comprises a fixed arm fixed to the base plate.

6. The paper feeder of claim 1 wherein the elastic device comprises a connecting rod and a spring, wherein a pivot of the connecting rod rotatably fixed to the base plate and a rotating arm of the connecting rod set within the chute in a slidable way, one end of the spring connects to the rotating arm of the connecting rod and the other end of the spring connects to the base plate.

7. A paper feeder comprising:

a base plate;

a movable paper holder for holding papers, comprising a pivot fixed to the base plate and a rotating end positioned above the base plate in a rotatable way; and means for providing a substantially constant vertical force exerted to the movable paper holder;

wherein the providing means comprises a first end and a second end, the first end coupled to the base plate and the second end coupled to the movable paper holder.

8. The paper feeder of claim 7 further comprises a pickup roller positioned above the movable paper holder for picking up papers.

9. The paper feeder of claim 7 wherein the providing means comprises a chute set on the upper side of the base plate and a connecting rod with a pivot fixed to the bottom side of the moveable paper holder and a sliding end of the connecting rod positioned within the chute in a slideable way, the connecting rod forming an acute angle with the movable paper holder.

10. The paper feeder of claim 9 wherein the providing means further comprises an elastic device with one end connected with the sliding end of the connecting rod and the other end fixed to the upper side of the base plate.

11. A paper feeder comprising:

a base plate;

a movable paper holder for holding papers, comprising a pivot fixed to the base plate and a rotating end positioned above the base plate in a rotatable way; and an elastic device connecting the base plate and the underside of the movable paper holder, the elastic device comprising an elastic portion and a chute, an end of the elastic portion being capable of sliding within the chute to adjust an acute angle formed between th base plate and the elastic portion so that the vertical force provided by the elastic device to the moveable paper holder remains substantially constant.

12. The paper feeder of claim 11 further comprises a pickup roller positioned above the movable paper holder for collecting papers.

13. The paper feeder of claim 11 wherein the elastic portion forms an acute angle with the extending rotating end of the movable paper holder.

14. The paper feeder of claim 11 wherein the elastic portion is a swing arm of a torsion spring, which comprises a fixed arm fixed to the bottom side of the movable paper holder.

15. The paper feeder of claim 11 wherein the elastic portion is a spring.

16. The paper feeder of claim 11 wherein the elastic portion is a swing arm of a torsion spring, the torsion spring comprises a fixed arm fixed to the base plate.

17. The paper feeder of claim 11 wherein the elastic portion comprises a connecting rod and a spring, a pivot of the connecting rod rotatably fixed to the base plate and a rotating arm of the connecting rod set within the chute in a slidable way, one end of the spring connects to the rotating arm of the connecting rod and the other end of the spring connects to the base plate.

18. The paper feeder of claim 11 wherein the elastic portion comprises a connecting rod with a pivot fixed to the bottom side of the moveable paper holder and a sliding end of the connecting rod positioned within the chute in a slideable way.

19. The paper feeder of claim 18 wherein the elastic portion further comprises a spring with one end connected with the sliding end of the connecting rod and the other end fixed to the upper side of the base plate.

* * * * *